US008439165B2

(12) United States Patent
Busschaert et al.

(10) Patent No.: US 8,439,165 B2
(45) Date of Patent: May 14, 2013

(54) COLLAPSIBLE SAW HORSES

(75) Inventors: Jason F. Busschaert, Bel Air, MD (US); James A. Downing, Owings Mills, MD (US); Torrey R. Lambert, Baltimore, MD (US)

(73) Assignee: Black & Decker Inc., Newark, DE (US)

( * ) Notice: Subject to any disclaimer, the term of this patent is extended or adjusted under 35 U.S.C. 154(b) by 1 day.

(21) Appl. No.: 12/940,384

(22) Filed: Nov. 5, 2010

(65) Prior Publication Data

US 2012/0111667 A1 May 10, 2012

(51) Int. Cl.
*E04G 1/34* (2006.01)

(52) U.S. Cl.
USPC ..... 182/155; 182/225

(58) Field of Classification Search ..... 182/129, 182/153, 155, 181.1, 225; 292/194, 195, 292/200, 288, 230, 231, 236, DIG. 63, 95, 292/96, 99, 101; 24/584.1, 587.1, 587.11; 220/7, 6, 4.33, 4.28, 666; 16/231, 232
See application file for complete search history.

(56) References Cited

U.S. PATENT DOCUMENTS

| | | | | |
|---|---|---|---|---|
| 861,496 | A * | 7/1907 | Breckenridge | 108/28 |
| 1,519,717 | A * | 12/1924 | Bilodeau | 292/100 |
| 5,007,502 | A * | 4/1991 | Shapiro | 182/155 |
| 5,310,358 | A | 5/1994 | Johnson et al. | |
| 6,233,897 | B1 * | 5/2001 | Jurik | 52/604 |
| 6,517,372 | B1 | 2/2003 | Jones | |
| 6,994,224 | B2 * | 2/2006 | Barger et al. | 213/75 TC |
| D648,443 | S * | 11/2011 | Busschaert et al. | D25/68 |
| 2001/0027902 | A1 * | 10/2001 | Ishiguro | 190/108 |
| 2003/0094392 | A1 * | 5/2003 | Meier et al. | 206/503 |
| 2007/0222231 | A1 * | 9/2007 | Vilkomirski | 292/226 |
| 2010/0288585 | A1 * | 11/2010 | Katz et al. | 182/155 |

FOREIGN PATENT DOCUMENTS

| | | | |
|---|---|---|---|
| EP | 2251155 | A1 | 11/2010 |
| GB | 2348924 | A | 10/2000 |

OTHER PUBLICATIONS

David Chariot, European Search Report, Feb. 10, 2012, The Hague, The Netherlands.

* cited by examiner

*Primary Examiner* — Katherine Mitchell
*Assistant Examiner* — Kristine Florio
(74) *Attorney, Agent, or Firm* — Adan Ayala

(57) ABSTRACT

A saw horse combination includes two saw horses. Each saw horse has a beam, first and second brackets disposed respectively at the ends of the beam, and legs pivotably attached to the brackets for supporting the beam. A locking mechanism is also provided for connecting the first and second horses. The locking mechanism includes a first latch movably connected to a bracket of the first saw horse, and a second latch movably connected to a bracket of the second saw horse. These latches are movable between a first position where the latches do not engage and a second position where the latches engage.

9 Claims, 3 Drawing Sheets

COLLAPSIBLE SAW HORSES

FIELD OF THE INVENTION

This invention relates generally to saw horses and more particularly to a combination of collapsible saw horses.

BACKGROUND OF THE INVENTION

It is common in the construction industry for users to bring multiple saw horses to the work site. In order to make the saw horses more transportable, several prior art designs teach collapsible saw horses. See, e.g., U.S. Pat. No. 6,745,804, which is wholly incorporated herein by reference. While such design allows a collapsed saw horse to be transported easily, it becomes more difficult to carry multiple saw horses.

SUMMARY OF THE INVENTION

In accordance with the present invention, a saw horse combination comprises two saw horses. Each saw horse has a beam, first and second brackets disposed respectively at the ends of the beam, and legs pivotably attached to the brackets for supporting the beam. A locking mechanism is also provided for connecting the first and second horses. The locking mechanism includes a first latch movably connected to a bracket of the first saw horse, and a second latch movably connected to a bracket of the second saw horse. These latches are movable between a first position where the latches do not engage and a second position where the latches engage.

Additional features and benefits of the present invention are described, and will be apparent from, the accompanying drawings and the detailed description below.

BRIEF DESCRIPTION OF THE DRAWINGS

The accompanying drawings illustrate preferred embodiments of the invention according to the practical application of the principles thereof, and in which:

FIG. 1 illustrates a saw horse combination according to the present invention, where

FIG. 3 further illustrates the locking mechanism, where

FIG. 5 illustrates the manner in which the two saw horses interact, where

DETAILED DESCRIPTION

Figure 1A:
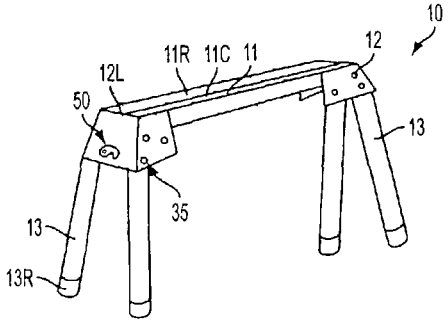
FIG. 1A is a perspective view of a saw horse and FIG. 1B shows two collapsed saw horses being combined for transportation.

The invention is now described with reference to the accompanying figures, wherein like numerals designate like parts. Referring to FIGS. 1-5, a saw horse 10, 10' has a structural body, such as beam 11, and at least one mounting bracket 12 disposed on the beam 11. Preferably, the beam 11 supports two mounting brackets 12.

Beam 11 is preferably elongated and tubular, and may have a thin wall which substantially defines the outer perimeter thereof. Such beam 11 can withstand substantial amounts of torsional and lateral loads applied thereto. Beam 11 can be made of extruded aluminum, bent metal, fabricated sheet metal, etc. Beam 11 may have rails 11R and/or channels 11C.

Bracket 12 may wrap around the end of beam 11. Preferably, bracket 12 is made of metal, such as sheet steel. Bracket 12 may also be shaped so that it matches the upper profile of beam 11. Alternatively bracket 12 may have an upper lip 12L that extends beyond the upper profile of beam 11.

In addition, the saw horse 10, 10' may have leg assemblies 13 for supporting the beam. Preferably, the leg assemblies 130 may be pivotally connected to the beam 11 via brackets 12. Leg assembly 13 is preferably made of metal, such as extruded aluminum with a round or ob-round (with two opposing substantially flat sides) cross-section.

Leg assembly 13 may have an end 13R, which may be made of an elastomeric material, a plastic or rubber. Preferably, the end 13R is made of a material that prevents slippage of the leg assembly 13 along a floor or other supporting surface. End 13R may be attached to leg assembly 13 via a screw (not shown).

It is preferable to provide leg assembly 13 with a detent mechanism 35 to maintain the leg assembly 13 in predetermined positions. Different detent mechanisms may be found in U.S. Pat. Nos. 4,605,099 and 5,592,981, which are hereby incorporated by reference.

Figure 2:
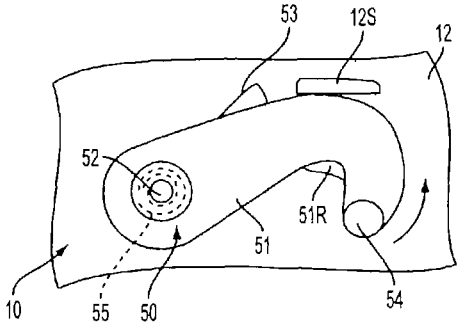
FIG. 2 is a side view of a portion of the locking mechanism according to the invention.
Figure 3B:
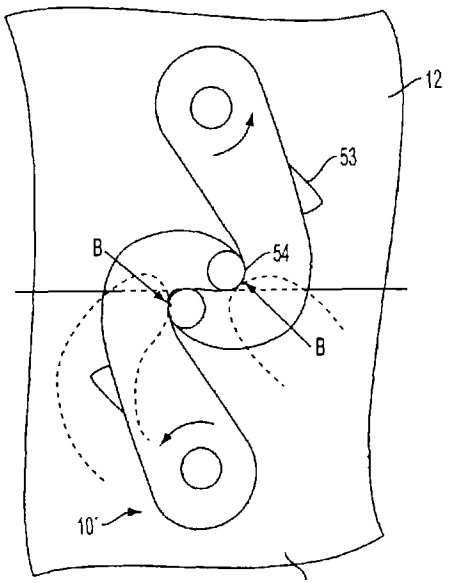
FIGS. 3A-3B are side views showing the locking mechanism in the disengaged and engaged positions respectively and FIG. 3C is a top view of the locking mechanism in the engaged position.
Figure 3A:
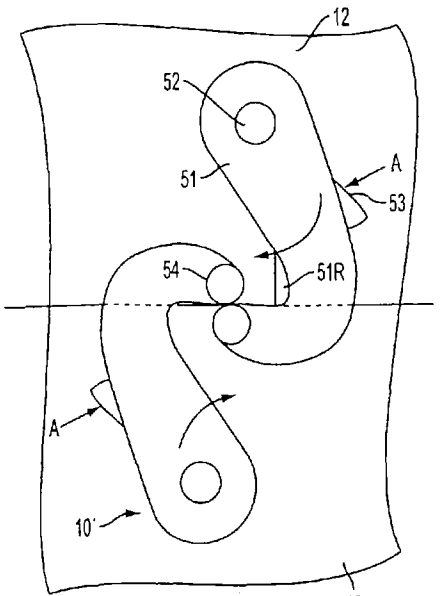
Figure 3C:
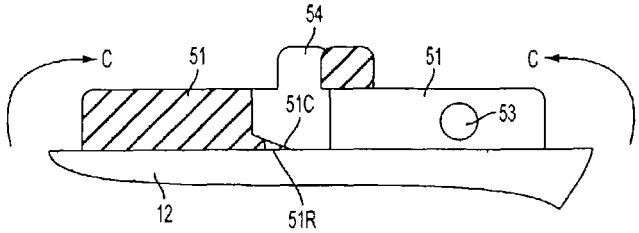
Figure 4:
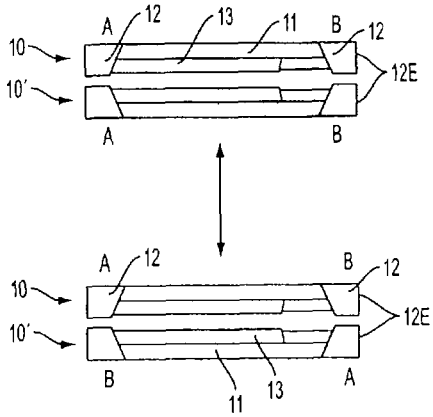
FIG. 4 is a side view of the two saw horses being assembled together regardless of orientation.

It is preferable to provide a locking mechanism 50 which would lock saw horses 10, 10' when they are stacked together. Referring to FIGS. 1-3, locking mechanism 50 includes a latch 51 movably attached to bracket 12. Preferably latch 51 is shaped as a hook. Latch 51 may be pivotably attached to bracket 12 via a bolt 52.

Preferably each bracket 12 on saw horses 10, 10' has a latch 51. When saw horses 10, 10' are stacked on each other, a user can move the latches 51 on the brackets 12 of saw horses 10, 10' towards each other in order to lock the saw horses 10, 10' together. As shown in FIGS. 2-3, latches 51 preferably have a surface 53 which can be engaged by the user. In particular, the user can exert forces A on surfaces 53 on each latch 51 with just two fingers, Preferably, latches 51 are made of plastic, which allows for some flexibility, allowing posts 54 to move past each other into the engaged position of FIG. 3B.

To disengage latches 51, the user can exert forces B unto posts 54. Again, the user may conveniently do this with only two fingers, moving the latches 51 from the engaged position of FIG. 3B towards the disengaged position of FIG. 3A.

Persons skilled in the art will recognize, because the latches 51 on saw horses 10, 10' are symmetrical, the latch 51 on a bracket 12 on saw horse 10 will engage latch 51 on either bracket 12 on saw horse 10'. In other words, referring to FIG. 4, latch 51 on bracket 12 at end A of saw horse 10 will engage latch 51 at either end A or B of saw horse 10'. Therefore, the orientation of saw horse 10 relative to saw horse 10' is irrelevant for engagement.

Figure 5A:
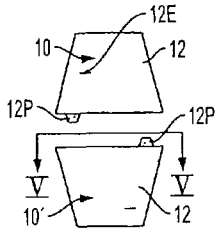
FIGS. 5A-5B are a side view of the two saw horses, and a view along line V-V shown in FIG. 5A, respectively.
Figure 5B:
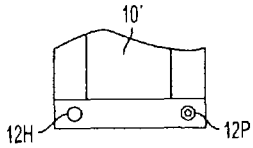

Referring to FIG. 5, it is preferable for brackets 12 to have protrusions 12P extending therefrom and a hole 12H. Preferably protrusion 12P is made of a resilient material such as rubber. Protrusion 12P may be shaped as a cylinder, a cone or a truncated cone. Again, symmetrical so that, when saw horse 10 is stacked on saw horse 10', protrusion 12P extending from saw horse 10 will enter the hole 12H on saw horse 10' and protrusion 12P extending from saw horse 10' will enter the hole 1211 on saw horse 10, regardless of the orientation of saw horse 10 relative to saw horse 10'. This arrangement will preferably ensure that saw horse 10 cannot move along its longitudinal axis relative to saw horse 10'.

Referring to FIG. 2, latch 51 may also have a spring 55 biasing latch 51 towards the disengaged position. Preferably, spring 55 is a rotational spring connected to latch 51 and bracket 12. Bracket 12 may have a stop 12S to limit the rotational movement of latch 51 when in the disengaged position.

Latch 51 preferably has an inclined rib 51R. Such rib 51R strengthens latch 51. In addition, rib 51R may engaged a cam surface 51C on the complementary latch 51, so that, when a torsion force C is applied to saw horses 10, 10' (e.g., when one end is unlatched and the unlatched brackets are moved away from each other), cam surface 51C will preferably ride on rib 51R, causing latches 51 to separate. Such feature ensures the durability of locking mechanism 50.

Figure 1B:
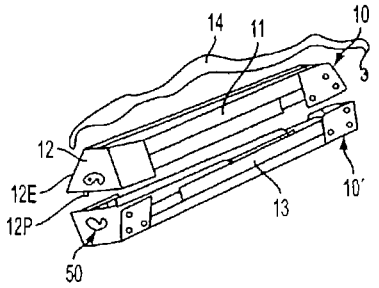

Referring to FIG. 1B, when saw horses 10, 10' are stacked together, a user can carry them together as a unit. Alternatively, brackets 12 may have a hole or eyelet 12E attached thereto. This would enable the user to connect a should strap 14 to the eyelet(s) 12E for easier transportion.

Persons skilled in the art may recognize other additions or alternatives to the means disclosed herein. However, all these additions and/or alterations are considered to be equivalents of the present invention.

The invention claimed is:

1. A saw horse combination comprising:

first and second saw horses, each saw horse comprising a beam having a longitudinal axis, first and second ends, first and second brackets disposed respectively at the first and second ends of the beam, legs pivotably attached to the first and second brackets for supporting the beam; and a locking mechanism for connecting the first and second saw horses, the locking mechanism comprising a first latch movably connected to the first bracket of the first saw horse, a second larch movably connected to the first bracket of the second saw horse, wherein the first and second latches are pivotable between a first position where the first and second latches do not engage each other and a second position where the first and second latches engage each other, the first latch being pivotable between the first and second positions about an axis which is substantially parallel to the longitudinal axis of the beam of the first saw horse, a third latch movably connected to the second bracket of the first saw horse, and a fourth latch movably connected to the second bracket of the second saw horse, wherein the first latch is engageable with one of the second and fourth latches, and the third latch is engageable with the other of the second and fourth latches, the first latch and the third latch being engageable with the second and fourth latches respectively when the first saw horse is in a first orientation relative to the second saw horse, and the third latch and the first latch being engageable with the second and fourth latches respectively when the first saw horse is in a second orientation relative to the second saw horse due to the interfitting mating structures of each respective latch.

2. The saw horse combination of claim 1, wherein the first latch is a hook.

3. The saw horse combination of claim 1, further comprising a first spring connected to the first latch for biasing the first latch towards the first position.

4. The saw horse combination of claim 3, wherein the first bracket of the first saw horse has a stop for contacting the first latch.

5. The saw horse combination of claim 1, wherein the first brackets of the first and second saw horses each having a protrusion and a hole, wherein the protrusion of the first bracket of the first saw horse engages the hole of the first bracket of the second saw horse, and the protrusion of the first bracket of the second saw horse engages the hole of the first bracket of the first saw horse.

6. The saw horse combination of claim 5, wherein the protrusions are shaped as a truncated cone.

7. The saw horse combination of claim 5, wherein the protrusions are made of a resilient material.

8. The saw horse combination of claim 1, wherein the first and second latches each has a first contact area for manually pushing the first and second latches towards the second position.

9. The saw horse combination of claim 8, wherein the first and second latches each has a second contact area for manually pushing the first and second latches towards the first position.

* * * * *